US009725796B2

(12) United States Patent
Waniuk et al.

(10) Patent No.: US 9,725,796 B2
(45) Date of Patent: Aug. 8, 2017

(54) COATING OF BULK METALLIC GLASS (BMG) ARTICLES

(71) Applicants: Apple Inc., Cupertino, CA (US); Crucible Intellectual Property, LLC, Dana Point, CA (US)

(72) Inventors: Theodore A. Waniuk, Lake Forest, CA (US); Joseph Stevick, Glendora, CA (US); Sean O'Keeffe, San Francisco, CA (US); Dermot J. Stratton, San Francisco, CA (US); Joseph C. Poole, San Francisco, CA (US); Matthew S. Scott, Campbell, CA (US); Christopher D. Prest, San Francisco, CA (US)

(73) Assignees: Apple Inc., Cupertino, CA (US); Crucible Intellectual Property, LLC, Rancho Santa Margarita, CA (US)

( * ) Notice: Subject to any disclaimer, the term of this patent is extended or adjusted under 35 U.S.C. 154(b) by 782 days.

(21) Appl. No.: 13/631,098

(22) Filed: Sep. 28, 2012

(65) Prior Publication Data

US 2014/0090752 A1 Apr. 3, 2014

(51) Int. Cl.
*C23C 8/06* (2006.01)
*C22C 45/00* (2006.01)
(Continued)

(52) U.S. Cl.
CPC ..... *C22C 45/00* (2013.01); *B22D 25/06* (2013.01); *B22D 27/006* (2013.01); *C22C 1/002* (2013.01);
(Continued)

(58) Field of Classification Search
CPC ..... C22C 45/00; C22C 45/001; C22C 45/003; C22C 45/02; C22C 1/002; C22C 33/003;
(Continued)

(56) References Cited

U.S. PATENT DOCUMENTS 5,288,344 A * 2/1994 Peker ..... C22C 45/10 148/403
5,368,659 A 11/1994 Peker
(Continued)

FOREIGN PATENT DOCUMENTS

JP 2001-303218 10/2001

OTHER PUBLICATIONS

Inoue et al, "Bulk amorphous alloys with high mechanical strength and good soft magnetic properties in Fe—Tm—B (Tm=IV-VIII group transition metal) system", Appl. Phys. Lett., vol. 71, p. 464 (1997).

(Continued)

*Primary Examiner* — Lois Zheng
(74) *Attorney, Agent, or Firm* — Brownstein Hyatt Farber Schreck, LLP

(57) ABSTRACT

Exemplary embodiments described herein relate to methods and apparatus for forming a coating layer at least partially on surface of a BMG article formed of bulk solidifying amorphous alloys. In embodiments, the coating layer may be formed in situ during formation of a BMG article and/or post formation of a BMG article. The coating layer may provide the BMG article with surface hardness, wear resistance, surface activity, corrosion resistance, etc.

20 Claims, 10 Drawing Sheets

(51) Int. Cl.

| | |
|---|---|
| ***B22D 25/06*** | (2006.01) |
| ***B22D 27/00*** | (2006.01) |
| ***C22C 1/00*** | (2006.01) |
| ***C22C 33/00*** | (2006.01) |
| ***C22C 45/02*** | (2006.01) |
| ***C22C 45/10*** | (2006.01) |
| *B22D 17/00* | (2006.01) |

(52) U.S. Cl.
CPC ..... *C22C 33/003* (2013.01); *C22C 45/001* (2013.01); *C22C 45/003* (2013.01); *C22C 45/02* (2013.01); *C22C 45/10* (2013.01); *C23C 8/06* (2013.01); *B22D 17/00* (2013.01)

(58) Field of Classification Search
CPC ..... B22D 17/00; B22D 25/06; B22D 27/006; C23C 8/06–8/38
See application file for complete search history.

(56) References Cited

U.S. PATENT DOCUMENTS

| | | | | |
|---|---|---|---|---|
| 5,618,359 | A | 4/1997 | Lin | |
| 5,735,975 | A | 4/1998 | Lin | |
| 6,325,868 | B1 | 12/2001 | Kim | |
| 7,575,040 | B2 | 8/2009 | Johnson | |
| 2006/0086476 | A1* | 4/2006 | Peker | B22D 27/04 164/122 |
| 2007/0079907 | A1 | 4/2007 | Johnson | |
| 2008/0034796 | A1* | 2/2008 | Muramatsu | B21D 37/01 65/60.1 |
| 2008/0118387 | A1 | 5/2008 | Demetriou | |
| 2008/0135136 | A1 | 6/2008 | Demetriou | |
| 2009/0162629 | A1 | 6/2009 | Demetriou | |
| 2010/0084052 | A1 | 4/2010 | Farmer | |
| 2010/0230012 | A1 | 9/2010 | Demetriou | |
| 2010/0300148 | A1 | 12/2010 | Demetriou | |
| 2013/0112321 | A1* | 5/2013 | Poole et al. | 148/241 |

OTHER PUBLICATIONS

Shen et al, "Bulk Glassy CO43Fe20Ta5.5B31.5 Alloy with High Glass-Forming Ability and Good Soft Magnetic Properties", Materials Transactions, vol. 42 No. 10 (2001) pp. 2136-2139.

* cited by examiner

COATING OF BULK METALLIC GLASS (BMG) ARTICLES

The presently claimed invention was made by or on behalf of the below listed parties to a joint research agreement. The joint research agreement was in effect on or before the date the claimed invention was made and the claimed invention was made as a result of activities undertaken within the scope of the joint research agreement. The parties to the joint research agreement are APPLE INC. and LIQUIDMETAL TECHNOLOGIES, INC.

FIELD OF THE INVENTION

The present embodiments relate to bulk metallic glasses ("BMG") articles formed of bulk solidifying amorphous alloys. The present embodiments also relate to methods and apparatus of forming a coating layer on surface of a BMG article to provide the BMG article with surface hardness, wear resistance, surface activity, corrosion resistance, etc.

BACKGROUND

A large portion of the metallic alloys in use today are processed by solidification casting, at least initially. The metallic alloy is melted and cast into a metal or ceramic mold, where it solidifies. The mold is stripped away, and the cast metallic piece is ready for use or further processing. The as-cast structure of most materials produced during solidification and cooling depends upon the cooling rate. There is no general rule for the nature of the variation, but for the most part the structure changes only gradually with changes in cooling rate. On the other hand, for the bulk-solidifying amorphous alloys the change between the amorphous state produced by relatively rapid cooling and the crystalline state produced by relatively slower cooling is one of kind rather than degree—the two states have distinct properties.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. This amorphous state can be highly advantageous for certain applications. If the cooling rate is not sufficiently high, crystals may form inside the alloy during cooling, so that the benefits of the amorphous state are partially or completely lost. For example, one risk with the creation of bulk amorphous alloy parts is partial crystallization due to either slow cooling or impurities in the raw material.

Bulk-solidifying amorphous alloys have been made in a variety of metallic systems. They are generally prepared by quenching from above the melting temperature to the ambient temperature. Generally, high cooling rates, such as one on the order of 105° C./sec, are needed to achieve an amorphous structure. The lowest rate by which a bulk solidifying alloy can be cooled to avoid crystallization, thereby achieving and maintaining the amorphous structure during cooling, is referred to as the "critical cooling rate" for the alloy. In order to achieve a cooling rate higher than the critical cooling rate, heat has to be extracted from the sample.

Until the early nineties, the processability of amorphous alloys was quite limited, and amorphous alloys were readily available only in powder form or in very thin foils or strips with a critical thickness of less than 100 micrometers. A class of amorphous alloys based mostly on Zr and Ti alloy systems was developed in the nineties, and since then more amorphous alloy systems based on different elements have been developed. These families of alloys have much lower critical cooling rates of less than 103° C./sec, and thus they have much larger critical casting thicknesses than their previous counterparts. However, little has been shown regarding how to utilize these alloy systems into structural components, such as those in consumer electronic devices.

Thus, there is a need to provide BMG articles, BMG related devices, and their methods used for electronic devices/systems.

SUMMARY

The embodiments described herein relate to methods and apparatus for forming a coating layer at least partially on a BMG article. The embodiments described herein also relate to BMG articles having a coating layer at least partially thereon and/or electronic devices containing BMG articles having a coating layer at least partially thereon.

In accordance with various embodiments, there is provided an in situ method of forming a coating layer on a BMG article during formation of the BMG article. When forming the BMG article, a charge of molten metal alloy may be injected into a mold cavity. A chemically reactive gas may then be applied to chemically react with the molten metal alloy upon injected in the mold cavity to form a coating layer by the chemical reaction. The charge of the molten metal alloy may be cooled at a cooling rate such that the charge of molten metal alloy forms one or more BMG articles. Each of the one or more BMG articles may have the coating layer thereon.

In accordance with various embodiments, there is provided a method of forming a coating layer on a BMG article. The BMG article may be formed of bulk-solidified amorphous alloys and may be heated in a chemically reactive gas at a temperature such that the chemically reactive gas chemically reacts with a surface of the BMG article to form a coating layer. Note that the temperature is in a range substantially not to generate crystals in the BMG article.

In accordance with various embodiments, there is provided a method of locally forming a coating layer on a BMG article. The BMG article may be formed of bulk-solidified amorphous alloys and locally heated in a chemically reactive gas at a temperature such that the chemically reactive gas chemically reacts with one or more surface portions of the BMG article to locally form a coating layer on the one or more surface portions. Note that the temperature is in a range substantially not to generate crystals in the BMG article.

In accordance with various embodiments, there is provided a method of selectively forming a coating layer on a BMG article. The BMG article may be formed of bulk-solidified amorphous alloys. A chemically reactive gas is selectively exposed to one or more surface portions of the BMG article at a temperature such that the chemically reactive gas selectively reacts with the one or more surfaces of the BMG article to forming a coating layer. Note that the temperature is in a range substantially not to generate crystals in the BMG article.

In accordance with various embodiments, there is provided an article. The article may include a coating layer at least partially on surface of a BMG article. The BMG article may be formed of BMG alloys. The coating layer may include chemically reacted BMG alloys.

In accordance with various embodiments, there is provided an electronic device. The electronic device may include an article. The article may include one or more coating layers at least partially on surface of a BMG article. The BMG article may be formed of BMG alloys. The coating layer may include chemically reacted BMG alloys.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
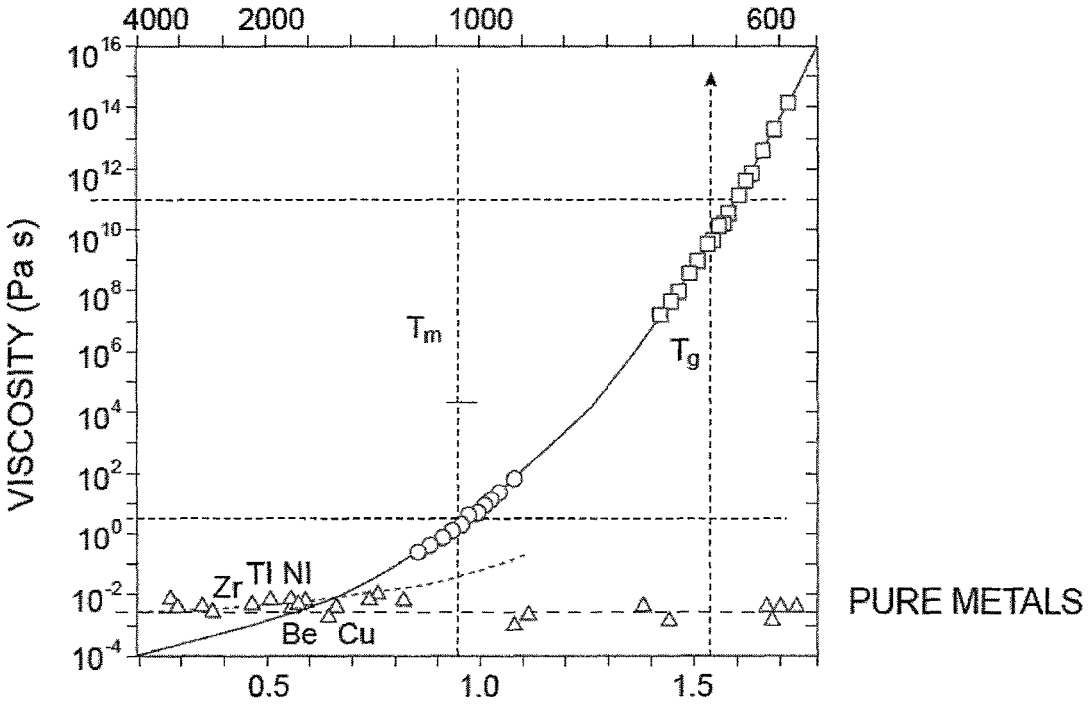
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
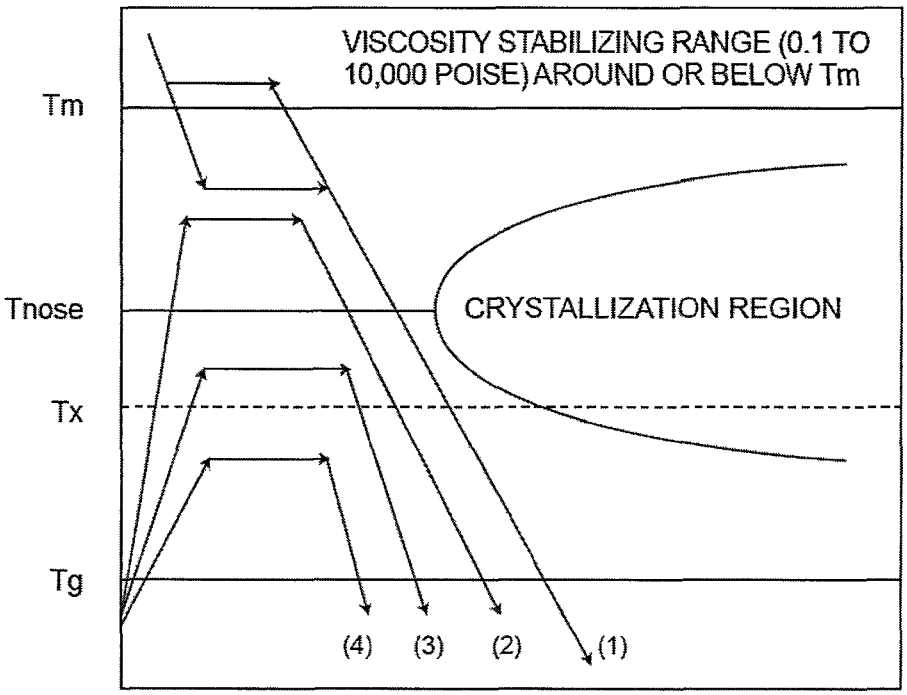
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between 10-12 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substeantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle s(x), s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)–e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo-Ln-C—B, Fe—Mn—Cr—Mo—(Y,Ln)—C—B, (Fe,Cr,Co)—(Mo, Mn)—(C,B)—Y, Fe—(Co,Ni)—(Zr,Nb,Ta)—(Mo,W)—B, Fe—(Al,Ga)—(P,C,B,Si,Ge), Fe—(Co,Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72Al7Zr10Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Cu4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The embodiments described herein relate to methods and apparatus of forming a coating or a coating layer at least partially on surface of a BMG article formed of BMG alloys (also referred to as bulk solidifying amorphous alloys). In embodiments, the coating layer may be formed in situ during formation of the BMG article and/or post formation of the BMG article. The coating layer may be controllably formed partially or wholly covering surfaces of a BMG article. The coating layer may provide desired properties.

The embodiments relate to an article having a core and a coating formed by exposing a molten alloy with a reactive gas so as to produce: (a) amorphous BMG core and amorphous coating with elevated levels of reacted gas in the coating, (b) amorphous BMG core and partially crystalline coating.

An embodiment relates to a method comprising injecting a charge of molten metal alloy into a mold cavity; applying a chemically reactive gas to chemically react with surface of the charge of the molten metal alloy after injection in the mold cavity to form a coating layer; and cooling the charge of the molten metal alloy at a cooling rate such that the charge of the molten metal alloy forms a bulk metallic glass (BMG) article having the coating layer thereon. The method could further comprise removing the BMG article comprising the coating layer from the mold cavity. The method could further comprise injecting multiple charges of molten metal alloy into a mold cavity at once.

Optionally, the chemically reactive gas comprises nitrogen, oxygen, air, water vapor, or combinations thereof. Optionally, the molten metal alloy comprises a Zr-based, Fe-based, Ti-based, Pt-based, Pd-based, gold-based, silver-based, copper-based, Ni-based, Al-based, Mo-based, Co-based alloy, or combinations thereof. Optionally, the coating layer has Vickers hardness of bout 500 Vickers to about 2500 Vickers. Optionally, the applying a chemically reactive gas to react with the molten metal alloy is at a temperature ranging from about 100° C. to about 2000° C. Optionally, the applying a chemically reactive gas to react with the molten metal alloy is at a temperature ranging from about 500° C. to about 1200° C. Optionally, the applying a chemically reactive gas to react with the molten metal alloy is for about 5 seconds to about 1 minute. Optionally, the applying a chemically reactive gas to react with the molten metal alloy is at atmospheric pressure. Optionally, the applying a chemically reactive gas to react with the molten metal alloy comprises using a temperature, pressure, and/or time to eliminate substantially all porosity in the molten metal alloy and/or to homogenize any residual casting segregation. Optionally, the cooling rate is in the range of from about 0.1 K/s to about 1000 K/s. Optionally, the cooling rate is in the range of from about 5 K/s to about 500 K/s.

Another embodiment relates to a method comprising providing a BMG article formed of bulk-solidified amorphous alloys; and exposing the BMG article in a chemically reactive gas at a temperature such that the chemically reactive gas chemically reacts with a surface of the BMG article to form a coating layer, wherein the temperature is in a range substantially not to generate crystals in the BMG article. The method could further comprise thermo-plastically reforming the BMG article prior to the exposing the BMG article. Optionally, the exposing the BMG article is for less than about 15 seconds. Optionally, the exposing the BMG article is at atmospheric pressure. Optionally, the exposing the BMG article comprises locally heating the BMG article in a chemically reactive gas at a temperature such that the chemically reactive gas chemically reacts with one or more surface portions of the BMG article to locally form a coating layer on the one or more surface portions, wherein the temperature is in a range substantially not to generate crystals in the BMG article. Optionally, the exposing the BMG articles comprises heating the BMG article. Optionally, the heating the BMG article comprises using a heat source comprising a laser and/or a light emitting diode (LED) to locally heat one or more surface portions of the BMG article. Optionally, the heating the BMG article comprises providing a spacious resolution on one or more surface of the BMG article. Optionally, the heating the BMG article comprises using a mask layer between a heating source and the BMG article to control heating areas on surface of the BMG article. Optionally, the heating the BMG article is done in less than about 15 seconds. Optionally, the exposing the BMG article comprises selectively exposing the chemically reactive gas to one or more surface portions of the BMG article at a temperature such that the chemically reactive gas selectively reacts with the one or more surfaces of the BMG article to forming a coating layer, wherein the temperature is in a range substantially not to generate crystals in the BMG article.

Another embodiment relates to an article comprising a coating layer at least partially on surface of a BMG article comprising a BMG alloy, wherein the coating layer comprises a chemically reacted BMG alloy.

Optionally, the coating layer is a patterned coating layer at least partially on surface of the BMG article. Optionally, the coating layer has a thickness ranging from about 0.01 micron to about 100 microns. Optionally, the coating layer has Vickers hardness of about 500 Vickers to about 2500 Vickers, more preferably 1000 Vickers to about 2000 Vickers. Optionally, the coating layer is at least 50% by volume being amorphous. Optionally, the coating layer comprises a nitride layer, an oxide layer, or a combination thereof. Optionally, the coating layer comprises a layer comprising one or more nitrides, and/or a layer of one or more oxides. Optionally, the coating layer comprises substantially ZrN or substantially $ZrO_2$. Optionally, the BMG article comprises a plurality of sub-structures.

Another embodiment relates to and electronic device comprising an article comprising a coating layer at least partially on surface of a BMG article, wherein the BMG article comprises BMG alloys and wherein the coating layer comprises chemically reacted BMG alloys. Optionally, the device is an electronic device selected from the group consisting of a telephone, a cell phone, a land-line phone, a smart phone, an electronic email sending/receiving device a television, an electronic-book reader, a portable web-browser, a computer monitor, a DVD player, a Blue-Ray disk player, a video game console, a music player, a device that provides controlling the streaming of images, videos, and sounds, a remote control, a watch, and a clock.

Coatings

The term "coating" of "coating layer" may be used interchangeably herein and refers to a covering, e.g., a layer of material, which is applied to and/or grown from a surface of an object. The object may be any kinds of object, for example, a BMG article. In one embodiment, the coating layer may be formed on at least one surface portion of a BMG article formed of BMG alloys (or bulk-solidifying amorphous alloys).

In various embodiments, the coating layer may be formed by applying chemically reactive gases to react with molten metal alloys, e.g., molten BMG alloys, upon its injection in a mold cavity at a temperature sufficient for reacting the chemically reactive gases with the molten metal alloys.

In various embodiments, the coating layer may be formed by heating BMG articles in chemically reactive gases at a desired temperature or elevated temperatures.

In various embodiments, the coating layer may be formed by selectively and/or locally exposing chemically reactive gases to BMG articles at a desired temperature or elevated temperatures. In other embodiments, the coating layer may be formed by selectively and/or locally heating BMG articles in chemically reactive gases at a desired temperature or elevated temperatures. The selectively and/or locally formed coating layer may be a patterned coating layer, or a coating layer including pieces of coatings formed on surfaces of the BMG article at desired surface portions.

In various embodiments, the disclosed methods and apparatus may be applied to any metal alloys, that are capable of reacting with a chemically reactive gas to form a coating layer. For example, the metal alloys may be Zr-based, Fe-based, Ti-based, Pt-based, Pd-based, gold-based, silver-based, copper-based, Ni-based, Al-based, Mo-based, Co-based, and the like. The chemically reactive gases may include, for example, nitrogen, oxygen, air, water vapor, any non-inert gas, or their combinations. The chemical reactions may therefore include, for example, oxidation, nitridation, etc.

The coating layer formed by chemical reactions may be tightly adherent to the underlying metal due to covalent bonding between the coating layer and the underlying metal alloys of the BMG article. The coating layer may have desired thicknesses and superior properties, required by specific applications, and determined by materials involved in the chemical reactions, the reaction conditions, etc.

The coating layer may have a thickness ranging from about 0.01 micron to about 100 microns, for example, from about 0.1 microns to about 20 microns, or from about 3 microns to about 6 microns, or about 0.1 micron or less.

The coating layer may exhibit desirable hardness, toughness, and bonding characteristics. The coating can also be partially and/or fully dense, partially and/or fully amorphous, and suitable for very wide temperature ranges.

The coating layer can have a Vickers hardness of at least about 500 Vickers to about 2500 Vickers, for example, 1000 Vickers to about 2000 Vickers, or about 1000 Vickers to about 1500 Vickers.

The coating layer produced by the methods and apparatus described herein can be a dense layer having low or substantially no porosity. For example, it can have less than or equal to about 5% (volume) of porosity, such as less than or equal to about 1% of porosity, such as less than or equal to about 0.5% of porosity. Depending on the context, including the materials and the production and processing methods used, the afore described percentages can be weight percentages, instead of volume percentages.

The coating layer can be at least partially amorphous, such as substantially amorphous or fully amorphous. For example, the coating layer can have at least 50% of its volume being amorphous, such as at least 60%, such as at least 80%, such as at least 90%, such as at least 95%, such as at least 99%, being amorphous. Higher volume of being amorphous may result in a harder, more corrosion resistant surface on the BMG article.

In another embodiment, the coating layer can be substantially fully or fully crystalline, e.g., composed substantially of and/or entirely of nitrides, oxides, carbides, etc. For example, a layer with a gradient in composition may be formed. Because the highest impurity concentration from reaction with the gas is on the surface, it can cause a fully crystalline (i.e. mixed Zr, Al, Ti, etc., nitrides) layer, wherein the middle region becomes partially crystalline, and the lowest affect layer remains amorphous but with a higher concentration of the impurity element.

The coating layer may be wear-resistant and/or corrosion resistant. Corrosion is the disintegration of an engineered material into its constituent atoms due to chemical reactions with its surroundings. This can refer to the electrochemical oxidation of metals in reaction with an oxidant such as oxygen. Formation of an oxide of a metal due to oxidation of the metal atoms in a solid solution is an example of electrochemical corrosion termed rusting. This type of damage typically can produce oxide(s) and/or salt(s) of the original metal. Corrosion can also refer to materials other than metals, such as ceramics or polymers, although in this context, the term degradation is more common. In other words, corrosion is the wearing away of metals due to a chemical reaction. Metals and alloys could corrode merely from exposure to moisture in the air, but the process can be strongly affected by exposure to certain substances such as salts. Corrosion can be concentrated locally to form a pit or crack, or it can extend across a wide area more or less uniformly corroding the surface. Because corrosion is a diffusion controlled process, it can occur on exposed surfaces. As a result, methods to reduce the activity of the exposed surface, such as a coating, passivation and chromate-conversion, can increase a material's corrosion resistance. The term "corrosion resistant" in the context of the coatings of the embodiments herein can refer to a material having a coating that has substantially less corrosion when exposed to an environment than that of the same material without the coating layer that is exposed to the same environment.

In embodiments, the coating layer may have oxide- or nitride-coated surfaces, which may be further processed to enhance their properties. For example, when used in biocompatibility and performance, phosphatadyl choline, heparin, proteins, or other surface treatment may be applied for reducing platelet adhesion or other adverse cellular or tissue response to surfaces in contact with blood, or boronated or silver-doped hardened surface layers to reduce friction and wear if the implant is subject to microfretting or other mechanical wear.

In embodiments, the coating layer will retain its integrity without separating from the BMG article. In addition, it can withstand high temperature, and could be more ductile and fatigue resistant than conventional coatings. Further, the coating layer can provide desired electrical insulation, biocompatibility, blood compatibility, microfretting resistance, where applicable.

BMG Articles

BMG articles may be formed by, for example, die-casting or other applicable casting methods and apparatus. The BMG article may have various three dimensional (3D) structures as desired, including, but not limited to, flaps, teeth, deployable teeth, deployable spikes, flexible spikes, shaped teeth, flexible teeth, anchors, fins, insertable or expandable fins, anchors, screws, ridges, serrations, plates, rods, ingots, discs, balls and/or other similar structures.

Metal alloys used for forming BMG articles may be Zr-based, Fe-based, Ti-based, Pt-based, Pd-based, gold-based, silver-based, copper-based, Ni-based, Al-based, Mo-based, Co-based alloys, and the like, and combinations thereof. The BMG alloys may include at least one reactive element that is capable of reacting with chemically reactive gases to form desired coating layers.

For illustration purpose, the present application is primary described related to exemplary Zr-based alloys, although the methods and apparatus may be applied to any metal alloys.

Exemplary Zr-based alloys may include any alloys (e.g., BMG alloys or bulk-solidifying amorphous alloys) that contain Zr. In addition to containing Zr, the Zr-based alloys may further include one or more elements selected from, Hf, Ti, Cu, Ni, Pt, Pd, Fe, Mg, Au, La, Ag, Al, Mo, Nb, Be, or any combinations of these elements, e.g., in its chemical formula or chemical composition. The elements can be present at different weight or volume percentages. In embodiments, the Zr-based alloys may be free of any of the aforementioned elements to suit a particular purpose. For example, in some embodiments, the Zr-based metal alloys, or the composition including the Zr-based metal alloys, may be substantially free of nickel, aluminum, titanium, beryllium, and/or combinations thereof. In one embodiment, the Zr-based metal alloy, or the composition including the Zr-based metal alloy may be completely free of nickel, aluminum, titanium, beryllium, and/or combinations thereof.

Exemplary Zr-based BMG alloys may be Zr—Ti—Ni—Cu based amorphous alloy, e.g., having the formula (Zr, Ti)a(Ni, Cu, Fe)b(Be, Al, Si, B)c; (Zr, Ti)a(Ni, Cu)b(Be)c; and/or (Zr)a(Nb, Ti)b(Ni, Cu)c(Al)d as previously described in this application. Exemplary Zr-based BMG alloys may be Zr—Al based amorphous alloy, for example, having about 60% zirconium and about 38% copper by weight or by volume, with the rest of aluminum and nickel. In some embodiments, examples of Zr-based BMG alloys may include those listed in Table 2.

Melting of Metal Alloys

To form a BMG article, metal alloys to be cast must first be melted, e.g., in a non-reactive environment, to prevent any reaction, contamination or other conditions which might detrimentally affect the quality of the resulting BMG articles. For example, the metal alloys may be melted in a vacuum environment or in an inert environment, e.g., argon. In some cases, since any gasses in the melting environment may become entrapped in the molten material and result in excess porosity in cast article, the metal alloys may be melted in a vacuum environment. For example, a melt chamber may be coupled to a vacuum source in which metal alloys are melted in a melt chamber. In embodiments, single charges or multiple charges of materials at once may be melted.

In embodiments, the molten metal alloys may be an inductively melted metal alloy. For example, metal alloys may be melted using an induction skull remelting or melting (ISR) unit, or using other manners, such as by vacuum induction melting (VIM), electron beam melting, resistance melting or plasma arc, etc. Once one or several charges of metal alloys are melted in a vacuum environment, in an exemplary die casting process, the molten metal alloys are then transferred into a shot sleeve of a die casting apparatus for injection into a die cavity.

However, since the metal alloys are melted in a vacuum, any equipment used to transfer the molten material must be capable of withstanding high temperatures and be positioned in the vacuum chamber, and consequently the vacuum chamber must be relatively large.

In one example, when induction skull remelting or melting (ISR) is used to melt the metal alloys, for example in a crucible which is capable of rapidly, cleanly melting a single charge of material to be cast, e.g., up to about 25 pounds of material. In ISR, material is melted in the crucible defined a plurality of metal (e.g., copper) fingers retained in position next to one another. The crucible is surrounded by an induction coil coupled to a power source. The fingers include passages for the circulation of cooling water from and to a water source to prevent melting of the fingers. The field generated by the coil passes through the crucible, and heats and melts metal alloy material located in the crucible. The field also serves to agitate or stir the molten metal alloys. A thin layer of the material freezes on the crucible wall and forms the skull, thereby minimizing the ability of molten material to attack the crucible. By properly selecting the crucible and coil, and the power level and frequency applied to the coil, it is possible to urge the molten material away from the crucible, in effect levitating the molten material.

Since some amount of time will necessarily elapse between material melting and injection of the molten material into the die, the material is melted at a temperature high enough to ensure that the material remains at least substantially molten until it is injected, but low enough to ensure that solidification occurs at desired cooling rate to form BMG articles. In the case that a relative low temperature is used, transfer and injection of molten metal must be rapid enough prior to metal solidification.

The cooling rate of the molten metal alloys to form a BMG article has to such that the time-temperature profile during cooling does not traverse through the nose-shaped region bounding the crystallized region in the TTT diagram of FIG. 2. Also, amorphous metals/alloys can be produced with cooling rates high (rapid) enough, e.g., higher than the critical cooling rate, to allow formation of amorphous materials, and low enough to allow formation of amorphous structures in thick layers—e.g., for bulk metallic glasses (BMG). Zr-based alloy systems including different elements, may have lower critical cooling rates of less than 103° C./sec, and thus they have much larger critical casting thicknesses than their counterparts. In embodiments, in order to achieve a cooling rate higher than the critical cooling rate, heat has to be extracted from the sample.

Methods and Apparatus

Figure 3:
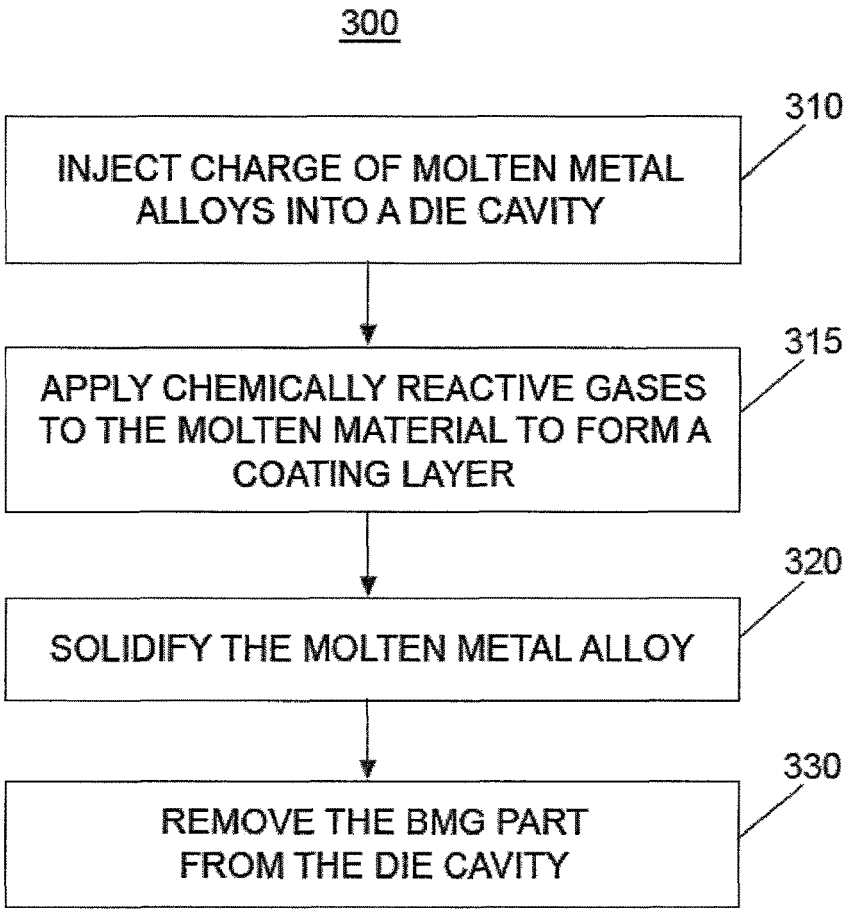
FIG. 3 is a flow diagram illustrating an exemplary method for forming a BMG article having a coating layer thereon in accordance with various embodiments of the present teachings.

FIG. 3 is a flow diagram illustrating an exemplary method for forming a BMG article having a coating layer in accordance with various embodiments of the present teachings. Note that the method depicted in FIG. 3 will be described herein with respect to an exemplary die-casting apparatus depicted in FIG. 4, although one of ordinary skill in the art will appreciate that the methods and the apparatus are not limiting in any manners.

Figure 4:
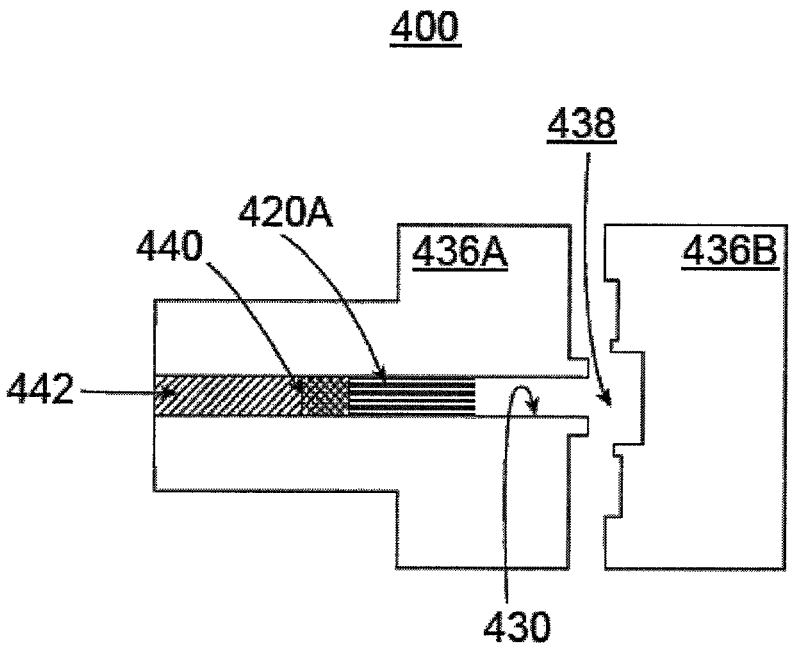
FIG. 4 depicts an exemplary die-casting apparatus in accordance with various embodiments of the present teachings.

At block 310 of FIG. 3, under vacuum pressure, one or multiple charges of molten metal alloys, for example, a metal alloy ingot 420, may be transferred, e.g., from a melt chamber or a crucible of an ISR unit, to a shot sleeve 430 of apparatus 400 of FIG. 4 to at least partially fill the shot sleeve and then injected into a die cavity 438 of apparatus 400.

In some embodiments, when ISR unit is used, the crucible may be mounted for translation and for pivotal movement about a pouring axis (not shown), and in turn is mounted to a motor for rotating the crucible to pour molten material from the crucible through a pour hole of the shot sleeve 430, with or without a pour cup or funnel coupled to the sleeve. In other embodiments, translation may occur from a melt chamber in which metal alloys are melted to a position in a vacuum chamber in which the shot sleeve is located.

As shown in FIG. 4, the shot sleeve 430 is coupled to a multipart die, which may be reusable and may include, e.g., two parts 436*a* and 436*b* as illustrated in FIG. 4. The two parts 436*a* and 436*b* may cooperate to define the die cavity 438. The die cavity 438 may include one cavity or more than one cavity to produce one article (e.g., BMG article) or more than one article, respectively. For example, multiple cavities may be coupled to a single shot sleeve 430. Molten metal alloys 420 may fill the die cavity 438 including one or more cavities, as well as associated runners, biscuit, etc. One part of the two die parts 436*a* and 436*b* may be fixed, while the other of the two parts is movable relative to the one part, for example driven by a hydraulic assembly. The dies 436 may include ejector pins (not shown) to facilitate ejecting final article(s) from the die 436. The die 436 may also be coupled to a vacuum source, to enable evacuation of the die prior to injection of the molten metal alloys.

In embodiments, the die may be composed of various materials, and should have good thermal conductivity, and be relatively resistant to erosion and chemical attack from injection of the molten metal alloys. A comprehensive list of possible materials may be quite large, and may include materials such as metals, ceramics, graphite and metal matrix composites. Non-limiting examples of die materials may include tool steels such as H13 and V57, molybdenum and tungsten based materials such as TZM and Anviloy, copper based materials such as copper beryllium alloy "Moldmax"-high hardness, cobalt based alloys such as F75 and L605, nickel based alloys such as IN 100 and Rene 95, iron base alloys and mild carbon steels such as 1018. Selection of the die material is critical to producing articles economically, and depends upon the complexity and quantity of the article being cast, as well as on the current cost of the component. Each die material has attributes that makes it desirable for different applications. For low cost die materials, mild carbon steels and copper beryllium alloys may be used due to their relative ease of machining and fabricating the die. Refractory metal such as tungsten and molybdenum based materials may be used for higher cost, higher volume applications due to their good strength at higher temperatures. Cobalt based and nickel based alloys and the more highly alloyed tool steels may offer a compromise between these two groups of materials.

In embodiments, an injection device may be used, such as a plunger 440 that cooperates with the shot sleeve 430 and hydraulics or other suitable assembly to drive and move the plunger 440 in the direction of arrow 442 and thereby inject the molten metal alloy ingot 420A from the sleeve 430 into the die cavity 438. In embodiments, the plunger may be controlled having a speed of between about 30 inches per second (ips) and 500 ips, or between about 50 ips and 175 inches per second (ips). The plunger may be moved at a pressure of at least about 1000 psi or at least 1500 psi. In embodiments, the ingot may be hot isostatically pressed (HIP'd) to reduce and substantially eliminate porosity in the articles as cast (see 420B of FIG. 5).

Figure 5:
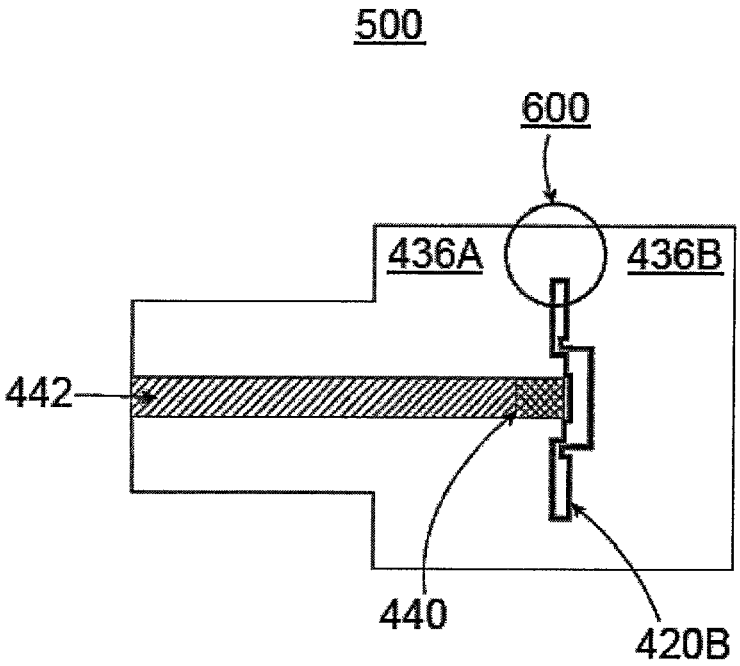
FIG. 5 depicts formation of an exemplary BMG article formed of bulk-solidifying amorphous alloys in accordance with various embodiments of the present teachings.

As the plunger 440 approaches the ends of its stroke to fill the die cavity 438, as shown in FIG. 5, the plunger 440 begins to transfer pressure to the metal alloys 420B. Intensification is also performed to minimize porosity, and to reduce or eliminate any material shrinkage during the subsequent cooling. Once the die cavity is filled, the pressure may be maintained until the casting of the molten metal alloys solidifies.

During the process, the shot sleeve and/or the die materials may be heated at certain temperatures according to the temperature of the molten metal alloys. Alternatively, the shot sleeve and/or the die material may be un-heated. In this case, the process including transferring and/or injection of molten metal alloys may be conducted within a few seconds. For example, the injection may occur in less than 3 seconds or less than 2 seconds.

In embodiments, coatings and surface treatments may be employed to enhance apparatus performance and the quality of resulting articles. In addition, a die lubricant may be applied to one or more selected parts of the die and the die casting apparatus. Any lubricant should generally improve the quality of resultant cast articles, and more specifically should be resistant to thermal breakdown, so as not to contaminate the material being injected.

Figure 6:
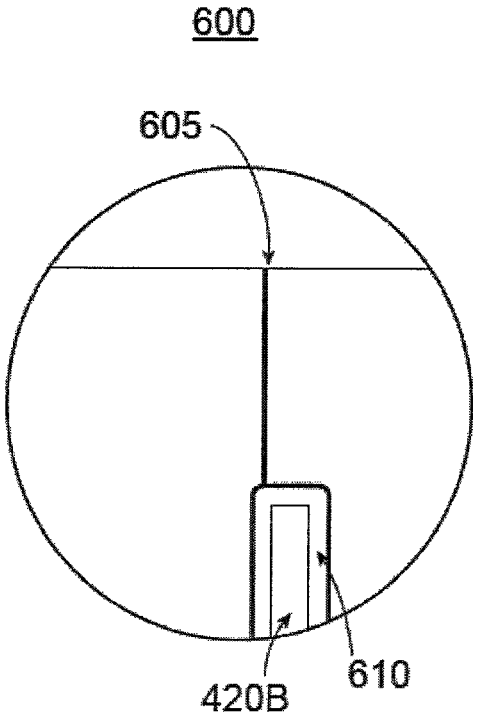
FIG. 6 depicts formation of a coating layer on an exemplary BMG article formed of bulk-solidifying amorphous alloys in accordance with various embodiments of the present teachings.

At block 315 of FIG. 3, chemically reactive gases 605, see FIG. 6, may be exposed to the molten metal alloys 420B injected in the die cavity 438, upon the molten metal alloys filling up the die cavity 438 and upon the plunger 440 stopping moving in the direction 442 (e.g., when the piston driving the plunger becomes stationary), such that the injected molten metal alloys 420B in the die cavity are still hot, i.e., having a selected temperature. Such temperature may be selected high enough to initialize the reaction between the chemically reactive gases 605 and reactive elements of the molten metal alloys 420B but low enough not to damage materials formed of the die mold.

In one embodiment, the molten metal alloys 420B exposed to the chemically reactive gases 605 may be at a temperature, e.g., an elevated temperature, ranging from about 900° C. to about 2000° C., for example, from about 1100° C. to about 1500° C., such as about 1300° C. The reaction time may be in a range of from about 5 seconds to about 1 minute, for example, about 15 seconds. The reaction may occur in an atmospheric pressure although other pressures may be applied without limitation. In embodiments, excess gases may be vented from the die cavity 438 to maintain the atmospheric pressure or any other desire pressure for the chemical reaction occurring on surface of the hot metal alloy 420B in the die cavity 438.

A coating layer 610 may then be formed as the result of the chemical reaction. The coating layer 610 may have a thickness depending on the reaction conditions including, for example, reaction time, reaction temperature, reaction pressure, concentration and reactivity of corresponding reactants in both the chemically reactive gases 605 and the molten metal alloys 420B.

In one example, the chemically reactive gases 605 may include nitrogen, for example, commercially available high purity nitrogen, which can in situ react with (or nitride) Zr or other reactive metal elements in an Zr-based BMG alloy to form a layer of zirconium nitride (ZrN) and/or other possible nitrides, but still substantially zirconium nitride.

In another example, the chemically reactive gases 605 may include oxygen, which can in situ react with (or oxidize) Zr or other reactive metal elements of the Zr-based BMG alloy to form a layer of zirconium oxide ($ZrO_2$) and/or other oxides, but still substantially zirconium oxide. In embodiments, the color of zirconium oxide may range from blue to black, depending on zirconium concentration in the oxidized alloy or process conditions that produce the coating layer.

Such in situ methods as disclosed herein are different than conventional methods, which use salt baths.

At block 320 of FIG. 3, the molten metal alloy 420B having a coating layer 610 may be solidified in the die cavity 438 after a sufficient period of time has elapsed to ensure solidification of the metal alloys 420B to form one or more BMG articles having a coating layer 610 on BMG alloys (i.e., bulk-solidifying amorphous alloys). Solidification of the molten metal alloy 420B to from BMG article may involve a cooling rate to ensure the molten metal alloys are cooled to form a bulk-solidifying amorphous alloy. For example, the die cavity 438 may be a cold chamber-type die cavity. The die may also be attached to a source of coolant such as water or a source of heat such as oil to thermally manage the die temperature during operation. The injected molten metal alloy 420B may solidify at desired cooling rates to form BMG articles. In embodiments, when Zr-based alloy is used, the cooling rate may be of less than 500 K/s, for example, in the range of from about 5 K/s to about 500 K/s, for example, from about 5 K/s to about 400 K's, or from about 5 K/s to about 300 K/s, or from about 5 K/s to about 200 K/s, etc.

At block 330 of FIG. 3, the formed BMG articles having a coating layer at least partially formed thereon may be removed from the die cavity 438. In embodiments, the removal of BMG articles may involve ejection from the die cavity using ejector pins, for example.

By in situ incorporated into die casting, one or multiple BMG articles may be produced in a single casting. Die casting enables production of articles having more complex three dimensional shapes, thereby enabling new software design technology to be applied to and exploited in areas such as gas turbine engines and enabling production of more efficient airfoils and other components. The die casting may enable the production of articles having complex shapes utilizing materials that are difficult or impossible to forge into those shapes. Moreover, die cast articles have greater reproducibility than forged or investment cast articles, and can be produced nearer to their finished shape, and with a superior surface finish, which minimizes post forming finishing operations, all of which also reduces the cost of producing such articles.

Figure 7:
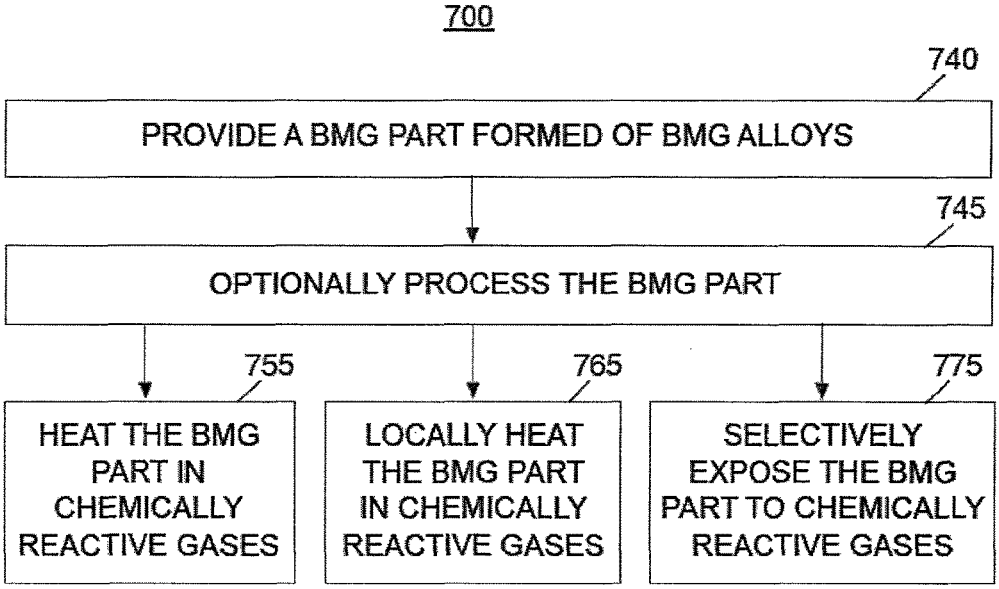
FIG. 7 is a flow diagram illustrating additional exemplary methods for forming a BMG article having a coating layer thereon in accordance with various embodiments of the present teachings.

FIG. 7 depicts exemplary methods of forming BMG article having a coating layer thereon in accordance with various embodiments of the present teachings. Note that the process depicted in FIG. 7 is described herein with respect to FIGS. 8-11, one of ordinary skill in the art would appreciate that the process in FIG. 7 and the structures in FIGS. 8-11 are not limited with one another or in any manner.

At block 740 of FIG. 7, a BMG article formed of BMG alloys may be provided. The provided BMG article may be any BMG articles as disclosed herein. The provided BMG article may have various structures, shapes, and/or dimensions. The BMG article may have a three dimensional (3D) structure formed by various sub-structures. For example, the BMG article may have a bulk component, a fixation component, and/or other possible component. The provided BMG article may have a desired thickness, e.g., less or greater than its critical casting thickness. The provided BMG article may be formed of various BMG alloys, such as, for example, Zr-based, Fe-based, Ti-based, Pt-based, Pd-based, gold-based, silver-based, copper-based, Ni-based, Al-based, Mo-based, Co-based alloys, and the like, and combinations thereof. The provided BMG article can be formed using various known casting methods.

At block 745 of FIG. 7, for example, the provided BMG article may be optionally used as a BMG feedstock for further processing to form a processed BMG article. The BMG feedstock may have a near net shape.

For example, the provided BMG article may be optionally re-formed, e.g., by thermo-plastic-forming, to have any possible three dimensional (3D) structures. In one embodiment, if the provided or otherwise formed BMG feed stock have at least one dimension less than or equal to a critical dimension of the BMG alloy(s) used. The BMG feed stock may be re-formed to have all dimensions greater than a critical dimension of the BMG alloys. In this case, during the process of thermo-plastic-forming, BMG feed stock may be heated to at least above the glass transition temperature of the each BMG alloy and plastically re-formed into a desired processed-BMG article. The thermo-plastic-forming may be conducted under pressure and may change dimensions and/or shapes of the BMG feedstock.

FIGS. 8-11 depict an exemplary BMG article 800 for illustration purpose. The BMG article 800 may be an as-formed BMG article by various casting methods or may be a processed BMG article processed post-formation or post-casting of a BMG feed stock or a BMG article.

In embodiments, the reaction temperature, time, and pressure for forming the coating layers in FIGS. 7-11 may be the same or different than what described in FIGS. 3-6 for forming the coating layer 610. Accordingly, the coating layers 610, 910, 1010, and 1110 in the figures may be the same or different as disclosed herein.

On the other hand, because the coating layers in FIGS. 7-11 are not formed in situ during formation of BMG article as depicted in FIGS. 3-6, but formed post-formation of BMG articles, the reaction conditions of temperature, time, and/or pressure may be chosen differently. Specifically, the heating process in FIGS. 8-11 may be controlled in a short time, for example, less than 15 seconds, or less than 5 seconds, such that no crystallization issue occurs, even in the case that a high temperature, e.g., ranging about 900° C. to about 2000° C. as discussed above, is used. The heating process in FIGS. 8-11 on a provided BMG article may be performed, e.g., by using laser, light emitting diode (LED), or other heating sources. Likewise, the reaction temperature to treat the BMG article in FIGS. 7-11 may be controlled to be sufficiently high to initialize the reaction between the chemically reactive gases and reactive elements of the molten metal alloys but in a range substantially not to generate crystals in the BMG article.

Figure 8:
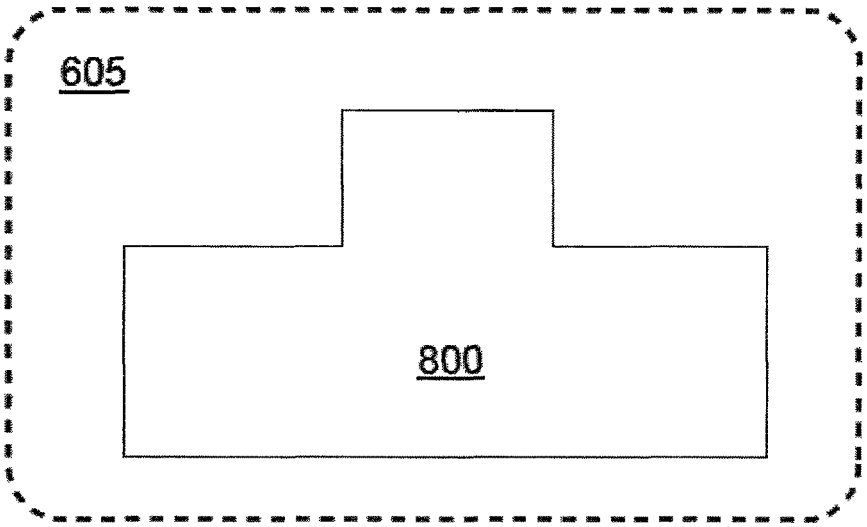
FIGS. 8-9 depict a method of forming a coating layer according to FIG. 7 in accordance with various embodiments of the present teachings.
Figure 9:
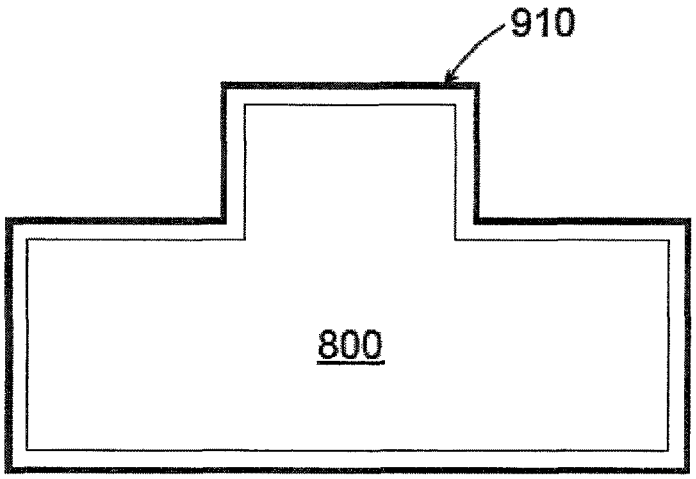

At block 755 of FIG. 7, a BMG article 800 may be placed in an environment containing chemically reactive gases 605, as shown in FIG. 8, and heated to initiate the reaction between reactive elements of the BMG article 800 and the chemically reactive gases 605 to form a coating layer 910, e.g., on all surfaces of the BMG article 800, as shown in FIG. 9.

Figure 10:
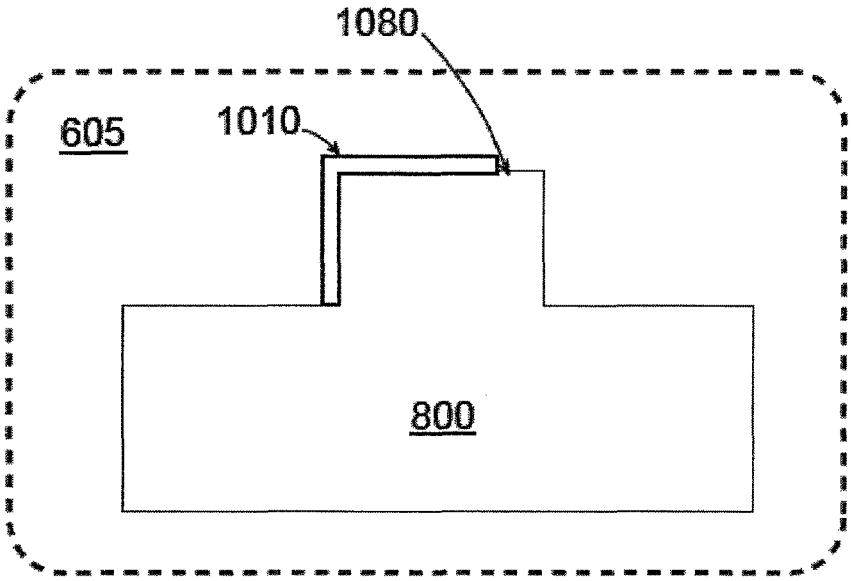
FIG. 10 depicts a method of locally forming a coating layer in accordance with various embodiments of the present teachings.

In embodiments, at block 765 of FIG. 7, a BMG article 800 may be at least partially coated on surface of the BMG article 800, e.g., by selectively or locally heating the BMG article 800 in an environment containing chemically reactive gases 605, as shown in FIG. 10.

The selective or local heating may initiate the chemical reaction between reactive elements of the BMG article 800 and the chemically reactive gases 605 to form a coating layer 1010 selectively on surfaces of the BMG article 800. Depending on the heating locations on surface of the BMG article 800, the coating layer 1010 may be a patterned coating layer or may be multiple layers located on desired surface portions of the BMG article 800. The local heating may be provided by any heating sources 1080 including, for example, laser, LED, etc.

In some embodiments, the heating sources 1080 may have controllable heating resolution to precisely heat spots or locations on surfaces of the BMG article 800. In other words, the BMG article may be locally heated with controllable spacious resolutions on one or more surface portions of the BMG article. In other embodiments, a mask layer may be placed between the heating sources 1080 and the surface portions to be coated of the BMG article 800. For example, the mask layer may have pre-designed pattern with some portions of the mask layer allowing penetration of heating energy from the heating sources 1080 to desired locations of the BMG article 800, while other portions of the mask layer not allowing, to form patterned coating layer on the BMG article 800.

Figure 11:
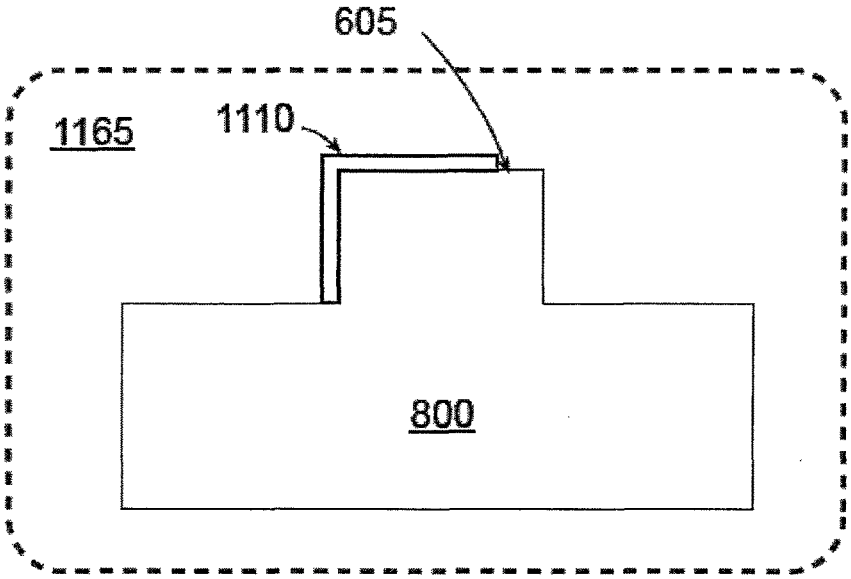
FIG. 11 depicts another method of locally forming a coating layer in accordance with various embodiments of the present teachings.

At block 775 of FIG. 7, a BMG article 800 may be at least partially coated on surface of the BMG article 800, e.g., by selectively exposing surface portions of the BMG article 800 to chemically reactive gases 605 at a temperature or at an elevated temperature as desired or in a heating environment having this desired temperature. The chemically reactive gases 605 may then selectively react with surface portions of the BMG article 800 to form a coating layer 1110 as shown in FIG. 11.

The disclosed coating layer may provide desired properties as described above. The disclosed coating layer may also provide surface morphologies as compared with other surfaces.

Example

Figure 12:
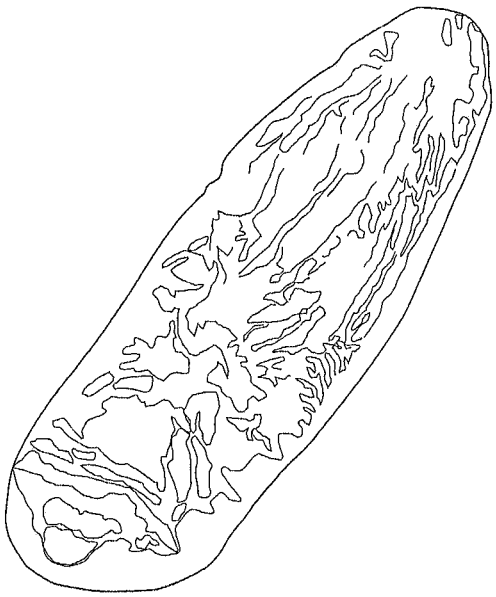
FIG. 12 depicts a photograph of a coating layer formed by an exemplary Zr-based alloy exposed to nitrogen gas when molten in accordance with various embodiments of the present teachings.
Figure 13:
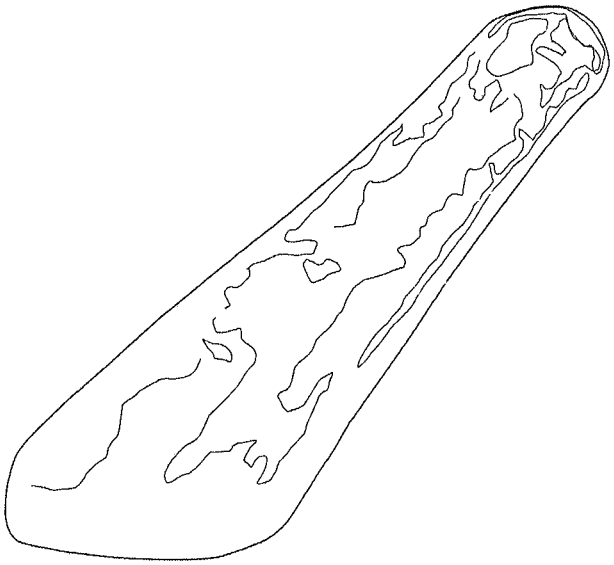
FIG. 13 depicts a photograph of a coating layer formed by an exemplary Zr-based alloy exposed to inter atmosphere when molten.

Such features and properties may be visible by melting a same alloy under different atmospheres. As an example, experiments were performed to check for Zr-based BMG reactivity with typical gases used for alloy melting (but, for this example, no sort of casting operation was involved). FIG. 12 is a photograph of a coating surface formed by an exemplary Zr-based alloy exposed to nitrogen gas when molten, while FIG. 13 is a photograph of a surface formed by the same Zr-based alloy exposed to inert atmosphere when molten. The inert atmosphere may be a vacuum atmosphere or any environment including inert gases such as argon, etc.

Figure 14:
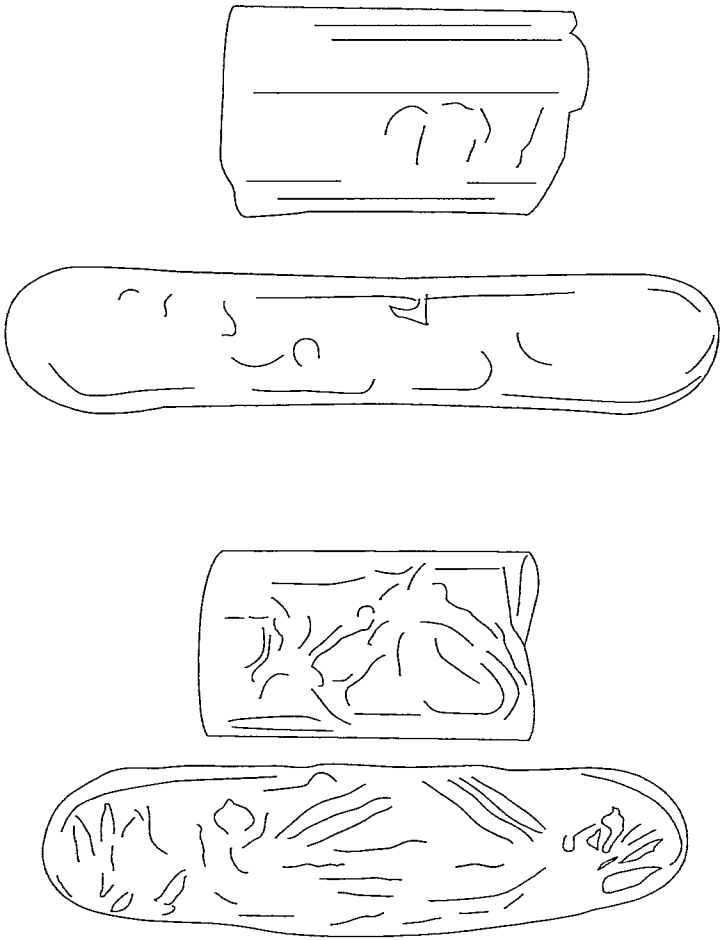
FIG. 14 depicts a photograph of the exemplary exposed alloys of FIGS. 12 and 13 side-by-side, respectively.

The test parameters were as follows:

Atmosphere: 2× [pump to 8 millitorr, backfill with gas to 1-2 psig], pump to <5 millitorr, backfill with gas to 2 psig overpressure and hold Heating: Inductively heat to 1050-1100C Material: Zr-based bulk amorphous alloy ingots, ~50 grams each The coating layer depicted in FIG. 12 provides different surface morphologies as compared to the surface layer depicted in FIG. 13 when the molten Zr-based alloy was exposed to a non-reactive inert environment. FIG. 14 shows a comparison of the results side-by-side. In FIG. 12, the Zr-based alloy sample was exposed to Argon (UHP). The alloy was heated for one minute under static 2 psig argon. During the process, the alloy melted rapidly with vigorous stirring. Temperature stabilized around 1100° C. as measured by the IR thermometer. After power was turned off, the alloy cooled much more rapidly than under vacuum. It was below the measurement range of the IR thermometer (550° C.) in a matter of seconds. The solidified ingot was quite shiny. In FIG. 13, the Zr-based alloy sample was exposed to Nitrogen (5N purity). The alloy was heated for one minute under static 2 psig nitrogen. During the process, the alloy melted rapidly, but stirring was obscured by a skin that appeared as soon as the alloy became fluid. Temperature stabilized around 1050° C. according to the IR thermometer. After power was turned off, the alloy cooled about as fast as under argon, i.e., much faster than in a vacuum environment. However, the solidified ingot surface was very wrinkled, with a gold color in some areas caused by the formation of a zirconium nitride layer.

It is likely that the nitrogen-melted alloy also had a substantial amount of N mixed into its bulk because of stirring, and was not only coated on its exterior.

Applications of Embodiments

The presently described methods provide significant improvements in hardness, wear resistance, surface activity, and corrosion resistance over other pre-existing, conventional coating methods. Because of the superior mechanical properties and resistance to corrosion, the presently described BMG article having the surface coatings can be used for a variety of devices including, but not limited to, in Yankee dryer rolls; automotive and diesel engine piston rings; pump components such as shafts, sleeves, seals, impellers, casing areas, plungers; Wankel engine components such as housing, end plate; and machine elements such as cylinder liners, pistons, valve stems and hydraulic rams. The coating is a part of a Yankee dryer, an engine piston; pump shaft, pump sleeve, pump seal, pump impeller, pump casing, pump plunger, component, Wankel engine, engine housing, engine end plate, industrial machine, machine cylinder liners, machine pistons, machine valve stems, machine hydraulic rams, or combinations thereof.

In embodiments, the methods may be used to form coatings on housings or other parts of an electronic device, such as, for example, a part of the housing or casing of the device or an electrical interconnector thereof. The methods can also be used to manufacture portions of any consumer electronic device, such as cell phones, desktop computers, laptop computers, and/or portable music players. As used herein, an "electronic device" can refer to any electronic device, such as consumer electronic device. For example, it can be a telephone, such as a cell phone, and/or a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The coating can also be applied to a device such as a watch or a clock.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A method comprising:

injecting a molten metal alloy into a mold cavity of a metal mold;

while the molten metal alloy is within the mold cavity, exposing a chemically reactive gas to the molten alloy to chemically react with a surface of the molten metal alloy and form a coating layer; and cooling the molten metal alloy at a cooling rate in the range of about 0.1 K/s to about 1000 K/s to form an article comprising at least a core formed from a bulk metallic glass (BMG).

2. The method of claim 1, wherein the chemically reactive gas comprises nitrogen, oxygen, air, water vapor, or combinations thereof.

3. The method of claim 1, wherein the molten metal alloy comprises a Zr-based, Fe-based, Ti-based, Pt-based, Pd-based, gold-based, silver-based, copper-based, Ni-based, Al-based, Mo-based, Co-based alloy, or combinations thereof.

4. The method of claim 1, wherein the coating layer has Vickers hardness of about 500 Vickers to about 2500 Vickers.

5. The method of claim 1, wherein the chemically reactive gas is at a temperature between about 100° C. to about 2000° C.

6. The method of claim 1, wherein the operation of exposing the chemically reactive gas to the molten metal alloy occurs for about 5 seconds to about 1 minute.

7. The method of claim 1, wherein the operation of exposing the chemically reactive gas to the molten metal alloy comprises applying a pressure to the chemically reactive gas and the molten metal alloy to eliminate substantially all porosity in the molten metal alloy and/or to homogenize residual casting segregation.

8. A method comprising:

introducing a molten metal alloy into a mold cavity;

introducing a chemically reactive gas into the mold cavity;

applying a pressure to the molten metal alloy and the chemically reactive gas in the mold cavity; and cooling the molten metal alloy at a cooling rate above about 0.1 K/s to form a metal article comprising an at least partially amorphous microstructure.

9. The method of claim 8, wherein applying the pressure to the molten metal alloy reduces porosity in the molten metal alloy.

10. The method of claim 8, wherein introducing the molten metal alloy into the mold cavity comprises pushing the molten metal alloy with a plunger.

11. The method of claim 8, further comprising venting excess chemically reactive gas from the mold cavity, thereby maintaining the pressure within the mold cavity while applying the pressure to the molten metal alloy and the chemically reactive gas.

12. The method of claim 8, wherein:

the molten metal alloy comprises a zircon-based bulk metallic glass alloy; and the chemically reactive gas comprises nitrogen.

13. The method of claim 12, wherein the nitrogen reacts with the zircon to form a layer of zirconium nitride on a surface of the metal article.

14. A method, comprising:

injecting a molten metal alloy into a mold cavity of a metal mold;

while the molten metal alloy is within the mold cavity, introducing a chemically reactive gas into the mold cavity, thereby forming a coating layer on substantially all surfaces of the molten metal alloy; and cooling the molten metal alloy at a rate sufficient to form an article comprising a core having an at least partially amorphous microstructure.

15. The method of claim 14, wherein the coating layer has a thickness between about 0.01 micron to about 100 microns.

16. The method of claim 15, wherein the coating layer has a higher hardness than the core of the article.

17. The method of claim 14, wherein:

the molten metal alloy comprises a zircon-based bulk metallic glass alloy;

the chemically reactive gas comprises oxygen; and the coating layer comprises zirconium oxide.

18. The method of claim 14, wherein:

the metal mold is coupled to a shot sleeve; and injecting the molten metal alloy into the mold cavity comprises pushing the molten metal alloy through the shot sleeve and into the metal mold with a plunger.

19. The method of claim 18, wherein introducing the chemically reactive gas into the mold cavity occurs after the plunger stops pushing the molten metal alloy into the metal mold.

20. The method of claim 19, further comprising maintaining, with the plunger, a pressure within the mold cavity while the chemically reactive gas is introduced into the mold cavity.

* * * * *